United States Patent [19]

Ünger

[11] 4,317,594

[45] Mar. 2, 1982

[54] MOUNTING FOR MATERIAL LOADING MEANS IN A MINING TUNNELLING MACHINE

[75] Inventor: Eberhart Ünger, Lunen, Fed. Rep. of Germany

[73] Assignee: Gewerkschaft Eisenhutte Westfalia, Lunen, Fed. Rep. of Germany

[21] Appl. No.: 159,157

[22] Filed: Jun. 13, 1980

[30] Foreign Application Priority Data

Jun. 19, 1979 [DE] Fed. Rep. of Germany ..... 2924550

[51] Int. Cl.[3] ..... E21C 27/24; E21C 35/20

[52] U.S. Cl. ..... 299/64; 198/522; 299/18

[58] Field of Search ..... 299/18, 56, 57, 64–68, 299/72; 198/522

[56] References Cited

U.S. PATENT DOCUMENTS

| | | | |
|---|---|---|---|
| 2,327,928 | 8/1943 | Osgood | 299/72 |
| 2,737,284 | 3/1956 | Ball | 299/64 X |
| 3,873,157 | 3/1975 | Stoltefuss et al. | 299/64 X |

*Primary Examiner*—Ernest R. Purser

*Attorney, Agent, or Firm*—Thompson, Birch, Gauthier & Samuels

[57] ABSTRACT

A machine for use in mining or tunnelling has a chassis supporting a mobile arm provided with rotary cutters. A shovel beneath the arm serves to transfer material onto a pair of conveyors mounted alongside the machine chassis. This shovel is supported for vertical pivoting displacement on a beam which is itself linked via a central pivot joint to the machine chassis. Piston and cylinder units effect tilting and vertical adjustment in the shovel position.

13 Claims, 3 Drawing Figures

MOUNTING FOR MATERIAL LOADING MEANS IN A MINING TUNNELLING MACHINE

BACKGROUND TO THE INVENTION

The present invention relates to a machine for use in mining or tunnelling operations.

U.S. Pat. No. 4,056,284 assigned to the same assignee as the present application describes a machine of the type with which the present invention is concerned and is herein incorporated by reference. The machine described in U.S. Pat. No. 4,056,284 utilizes as a loading means, a unit composed of conveyors and a material-receiving means, similar to a shovel, which receives material detached by the cutters at the end of a swinging arm or jib. A device is oscillated back and forth over the shovel to transfer material accumulating on the shovel onto the conveyors. The shovel together with front regions of the conveyors can be raised and lowered. This arrangement is not particularly adaptable to the prevailing conditions and a general object of this invention is to provide an improved mounting system for the loading means of the machine.

SUMMARY OF THE INVENTION

A machine constructed in accordance with the present invention has a frame or chassis supporting a jib or arm provided with cutting means and which can be moved in a variety of directions to attack a working face. Material receiving means such as a ramp-like shovel is disposed beneath the arm and its cutting means to receive material detached by the cutting means directly or otherwise. The material thus received is transferred to at least one conveyor leading away from the working face. In accordance with the present invention, the material-receiving means is mounted to the machine so it can be moved in a vertical sense and also tilted. Thus enables the material-receiving means to be adjusted to a desired position even when the machine is standing in an inclined disposition or when material has accumulated on the floor of the working unevenly. As is known per se, an oscillating device may transfer material from the upper face of the material-receiving means onto a pair of conveyors disposed at the sides of the machine chassis.

In a preferred embodiment of the invention the material-receiving means is supported on a bearing member, such as a beam, which is itself pivotably supported on the machine chassis to provide for the lateral tilting of the material-receiving means. The latter component may then be mounted for pivoting in a vertical sense on the bearing member. The pivot connection or joint between the machine chassis and the bearing member may take the form of a stout king pin engaging in a socket and having its pivot axis directed towards the working face.

Piston and cylinder units can be used to move the bearing member about its pivot connection with the machine chassis or frame. It is desirable to design the associated hydraulic system so that these units can be locked in the hydraulic sense with the bearing member set in a desired orientation and working position. At least one additional piston and cylinder unit can be used to adjust the material receiving means in the vertical sense by swinging the latter about its pivot connection with the bearing member.

It is also possible to connect the material-receiving means to the bearing member via parallel guide rods which render the material-receiving means vertically pivotable and bodily vertically adjustable.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawing wherein.

DESCRIPTION OF PREFERRED EMBODIMENT

Figure 1:
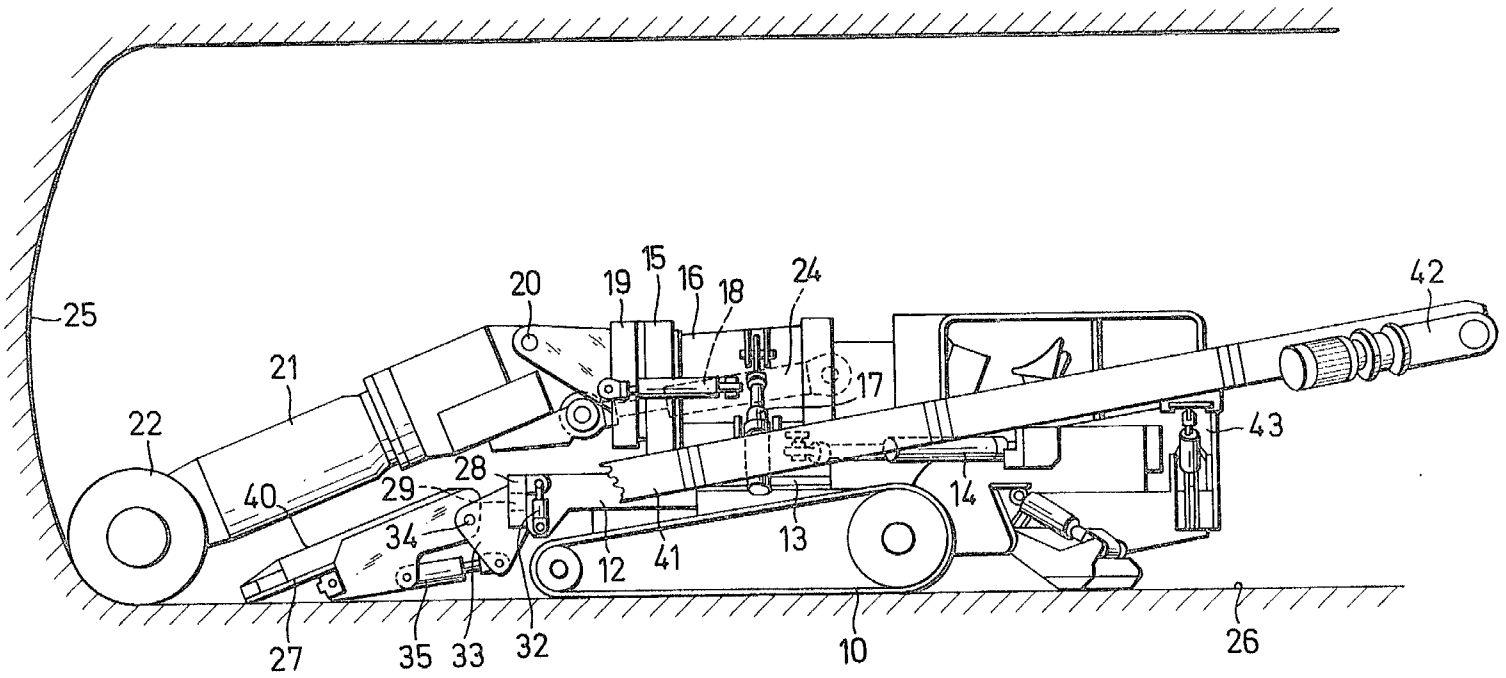
FIG. 1 is a schematic side view of a machine constructed in accordance with the invention.

As shown in FIG. 1, a machine constructed in accordance with the invention is composed of a main frame or body 12 supported for displacement on the floor of a working on two endless tracks 10. These tracks 10 are preferably driven hydraulically and are individually controlled and driven so the machine can be steered and manoeuvred. The frame 12 in turn carries a table or platform 13 which can be pivoted about a vertical axis in relation to the frame 12 by means of a pair of hydraulic piston and cylinder units 14. A superstructure or turntable 15 is mounted on the platform 13 and accommodates a support 16 which is pivotable or rotatable about an axis parallel to the longitudinal axis of the machine. The movement of the support 16 is effected by means of a pair of hydraulic piston and cylinder units 17 which are flexibly interconnected between the support 16 and the platform 13. The support 16 carries a bearing member 19. The bearing member 19 can be displaced longitudinally of the machine so as to extend or retract in relation to the support 16. This motion is effected by two hydraulic piston and cylinder units 18 flexibly interconnected between the support 16 and the bearing member 19. The bearing member 19 carries a cutting arm or jib 21 by way of a pivot joint 20 which permits the arm 21 to be raised or lowered. A cutting head 22 is provided at the free end of the arm 21 and this cutting head 22 can take the form of two cutter drums or rollers which are rotatably driven about an axis perpendicular to the longitudinal axis of the arm 21. The drive system for the cutting head 22 is conveniently located within the cutting arm 21. Two hydraulic piston and cylinder units 24 serve to raise or lower the arm 21 by pivoting about the joint 20. These units 24 are flexibly interconnected between the arm 21 and the member 16 and are at partly located inside the support 16. By operating the units 17, 18, 24 selectively the arm 21 can be brought into a variety of positions with respect to a working face 25, so the cutting head 22 can remove material over the entire face 25.

Figure 2:
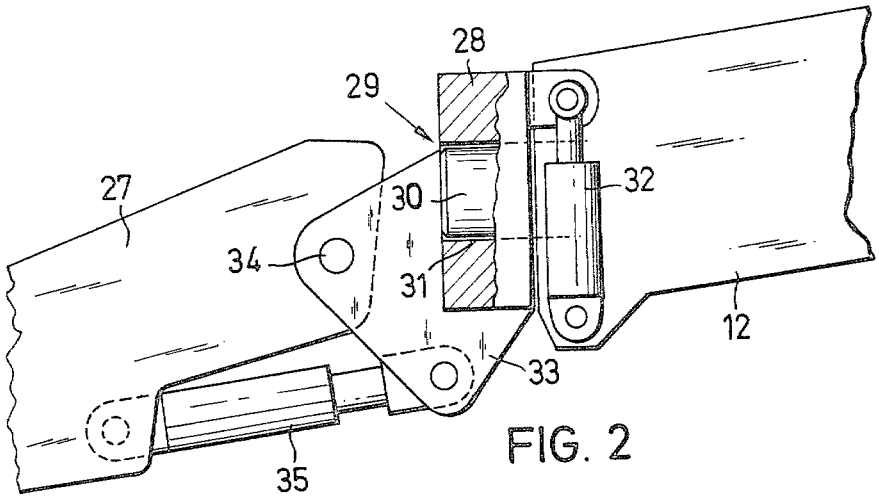
FIG. 2 is a side view of part of the machine taken on a somewhat larger scale.
Figure 3:
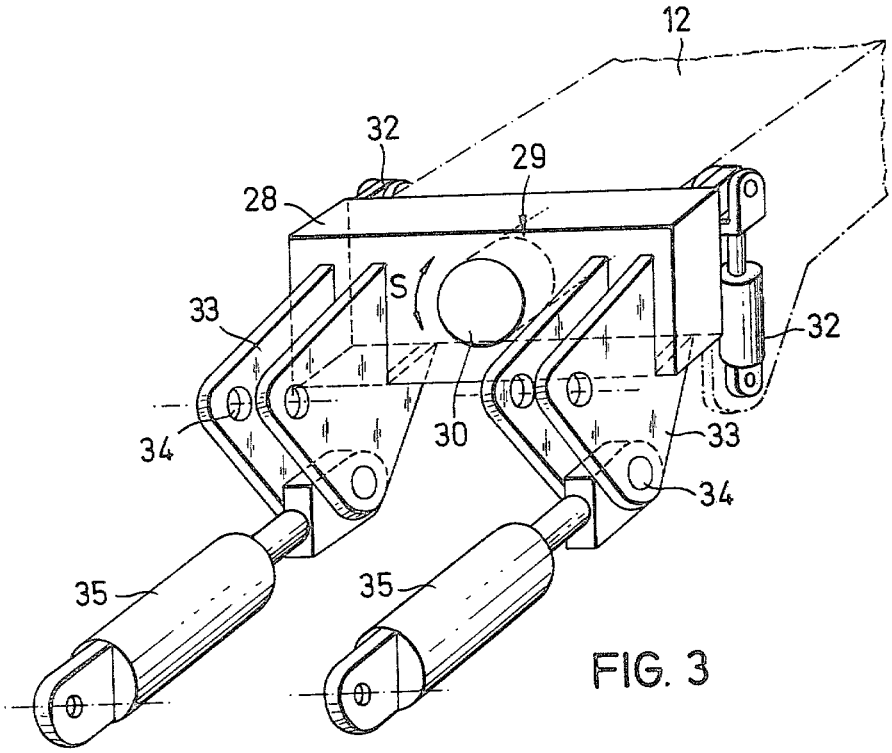
FIG. 3 is a perspective view of the mounting arrangement depicted in FIG. 2.

Beneath the cutting arm 21, there is material loading means composed of means for receiving material in the form of a shovel or ramp 27 which is inclined in relation to the floor 26 of the working. This shovel 27 is mounted to the frame 12 in a manner now described with reference to FIGS. 2 and 3. As shown in these Figures, a bearing member 28 is supported for tilting or swivelling motion on a pivot joint 29 formed at the front of the frame 12 only shown diagrammatically. The pivot axis of the joint 29 is directed towards the local working face 25 and can be disposed parallel to the longitudinal axis of the machine or inclined thereto. The pivot joint 29 is constituted by a strong rigid king pin 30 located more or less centrally of front end of the frame 12 and engaging in an aperture or socket 31 formed in the bearing member 28. The swivelling motion of the bearing member 28 is designated by the arrows in FIG. 3. The bearing member 28, which may take the form of a stout beam, is swivelled about the joint 29 with the aid of a pair of hydraulic piston and cylinder units 32 located at the sides of the joint 29. These units 32 are upstanding and flexibly interconnected between the frame 12 and the bearing member 28. By selective retraction and extension of the units 32 the bearing member 28 can be swivelled about the joint 29 in either a clockwise or anti-clockwise direction.

The bearing member 28 is provided with connection brackets 33 near its ends at either side of the joint 29. The shovel 27 is supported on the brackets 33 with the aid of pivot joints formed by pins locating in aligned apertures 34 in the brackets 33 and the shovel 27. The brackets 33 also support hydraulic piston and cylinder units 35 which are likewise pivoted thereto with pins locating in aligned apertures 34 in the lower regions of the brackets 33 and in head pieces of the piston rods of the units 35. The cylinders of the units 35 are pivotably linked to the shovel 27 so that by operating the units 35 the shovel 27 can be raised and lowered relative to the brackets 33. By operating the units 32, the shovel 27 can be tilted to one side or the other, while the units 35 enable the shovel 27 to be raised or lowered to any desired height. The material detached from the face 25 can thus be loaded onto the shovel 27 and if the machine is driven forwards to make the shovel 27 penetrate the material, the impact forces can be transferred to the machine frame 12 via the bearing member 28.

As represented in FIG. 1, at the upper side of the shovel 27, there is provided a transfer device or arm 30 which is designed to oscillate to and fro about an axis perpendicular to the shovel 27. In this way, material on the upper face of the shovel 27 is forced sideways onto two conveyors 41. These conveyors 41, which may take the form of scraper-chain conveyors, are located at the sides of the machine and are connected at their front end zones to the sides of the shovel 27 so as to move therewith. At their rear end zones, which are elevated, the conveyors 41 discharge the material and here the conveyors 41 are supported on a support and drive means 42. To accommodate for the displacement of the shovel 27, it is desirable to sub-divide the front end zones of the conveyors 41 from the remainder of the conveyors 41 and to provide a flexible joint or pivot joint therebetween.

I claim:

1. In a machine for use in mining or tunnelling which comprises a chassis or frame, an arm mounted on the chassis for movement in both vertical and lateral senses, cutting means provided on the arm and material loading means for transferring material detached by the cutting means, the improvement comprising: the loading means includes material-receiving means located beneath the arm and its cutting means, and means for mounting the material-receiving means to the machine chassis for vertical and lateral tilting displacements, said mounting means having a bearing member connected via a pivot joint to said machine chassis, the bearing member being movable about said pivot joint to effect the tilting of the material-receiving means.

2. A machine according to claim 1, wherein the material-receiving means is a ramp-like shovel.

3. A machine according to claim 1, wherein the loading means further comprises at least one conveyor for transferring material from the material-receiving means.

4. A machine according to claim 1, wherein the loading means further comprises a pair of conveyors located at the sides of the chassis for transferring material from the material receiving means.

5. A machine according to claim 4, wherein the conveyors are connected for movement with the material-receiving means.

6. A machine according to claim 4, wherein a loading arm is mounted above the material-receiving means for oscillating movement thereabove to push material onto the conveyors.

7. A machine according to claim 1, wherein at least one hydraulic piston and cylinder unit serves to move the bearing member about said pivot joint to adjust the tilting orientation of the material-receiving means.

8. A machine according to claim 1, wherein said pivot joint is composed of a king pin on the chassis engaging in a socket in the bearing member.

9. A machine according to claim 1, wherein said bearing member is a beam and the pivot joint is located at the center of the beam.

10. A machine according to claim 1, wherein a pair of hydraulic piston and cylinder units serves to move the bearing member about said pivot joint to adjust the tilting orientation of the material-receiving means.

11. A machine according to claim 1, wherein the material-receiving means is pivotably connected to the bearing member to effect said vertical displacement.

12. A machine according to claim 11, wherein at least one hydraulic piston and cylinder unit serves to effect the vertical displacement of the material-receiving means about its pivot connection with the bearing member.

13. A machine according to claim 11, wherein a pair of hydraulic piston and cylinder units are connected between brackets fitted to the bearing member and the material receiving means and these units serve to effect vertical displacement of the material-receiving means about pivot joints between the brackets and the material-receiving means.

* * * * *